US008211209B2

(12) United States Patent
Neff

(10) Patent No.: US 8,211,209 B2
(45) Date of Patent: Jul. 3, 2012

(54) PORTABLE HUMIDIFYING DEVICE AND METHOD FOR USING SAME

(76) Inventor: Mark David Neff, Potomac Falls, VA (US)

( * ) Notice: Subject to any disclaimer, the term of this patent is extended or adjusted under 35 U.S.C. 154(b) by 0 days.

(21) Appl. No.: 13/023,923

(22) Filed: Feb. 9, 2011

(65) Prior Publication Data

US 2011/0126704 A1 Jun. 2, 2011

Related U.S. Application Data

(62) Division of application No. 11/676,993, filed on Feb. 20, 2007, now Pat. No. 7,892,327.

(60) Provisional application No. 60/775,415, filed on Feb. 21, 2006, provisional application No. 60/883,078, filed on Jan. 2, 2007.

(51) Int. Cl.
*B01D 46/46* (2006.01)

(52) U.S. Cl. ..... 95/10; 95/90; 95/117; 96/108; 96/118; 55/385.4; 55/516; 165/222

(58) Field of Classification Search ..... 96/108, 96/118; 95/90; 165/222; 206/205, 242, 206/259, 213.1; 239/53, 55, 57
See application file for complete search history.

(56) References Cited

U.S. PATENT DOCUMENTS

| | | | | |
|---|---|---|---|---|
| 1,871,418 | A * | 8/1932 | Mckee | 96/118 |
| 2,464,966 | A * | 3/1949 | Defourneaux | 221/196 |
| 5,934,773 | A * | 8/1999 | Ferrell | 312/31.1 |
| 5,975,288 | A * | 11/1999 | Crowder et al. | 206/205 |
| 6,367,620 | B1 * | 4/2002 | Kelifa | 206/1.9 |
| 6,689,197 | B2 * | 2/2004 | Dick et al. | 96/118 |

OTHER PUBLICATIONS

Art-Sorb, High Performance Humidity Control Agent for the Conservation of Art, Art-Sorb Complete Information Packet—1998-1999, Fuji Silysia Chemical Ltd.*

* cited by examiner

*Primary Examiner* — Jason M Greene
*Assistant Examiner* — Karla Hawkins
(74) *Attorney, Agent, or Firm* — Katten Muchin Rosenman LLP

(57) ABSTRACT

Apparatuses for controlling a humidity level within an enclosed volume storage device and methods for using same. The apparatus, in one embodiment, comprises a container having outer walls defining an inner volume, at least one of the outer walls, preferably an lid wall, having perforations therein. The apparatus further comprises a composition capable of adsorbing and desorbing water and contained in the inner volume of the container. The composition is hydrated to a hydration level less than about 0.13 mL water per gram of the composition. The methods include a step of hydrating the composition in an apparatus of the invention to a hydration level less than about 0.13 mL water per gram of composition.

11 Claims, 2 Drawing Sheets

PORTABLE HUMIDIFYING DEVICE AND METHOD FOR USING SAME

CROSS-REFERENCE TO RELATED APPLICATIONS

This application is a divisional of and claims priority to copending U.S. patent application Ser. No. 11/676,993, filed Feb. 20, 2007, which claims priority to U.S. Provisional Application Ser. No. 60/775,415, filed Feb. 21, 2006, and to U.S. Provisional Patent Application Ser. No. 60/883,078, filed Jan. 2, 2007, the entireties of which are incorporated herein by reference.

BACKGROUND OF THE INVENTION

1. Field of the Invention This invention relates generally to humidification, and more particularly to devices and methods for maintaining a predetermined humidity level within a desired range in a relatively confined environment such as a cigar box or cigar humidor.

2. Description of Related Art

It is well known that the optimum range of relative humidity at which tobacco products such as cigars should be stored to optimize freshness is between 64% relative humidity to minimize drying of the tobacco and below 72% relative humidity to inhibit the growth of mold, mildew and prevent the hatching of the Cigarette or Tobacco Beetle, or *Lasioderna serricorne*, with 65-70% being ideal. Numerous efforts have been directed toward achieving this level of humidity in confined environments, such as humidors. Perhaps the most widespread devices include a slotted container containing a moisture releasing material inside. Conventional moisture releasing materials include water-impregnated ceramic blocks and water-impregnated open-cell foam, which is commonly referred to as "oasis" material or "floral foam" and used to hold and hydrate flower stems.

Many problems exist with these conventional moisture releasing materials. For example, in both cases, regular re-hydration is required by either manually removing the material and pouring distilled water over it or adding water to it while it is in the humidor. In either case, the risk of dripping or spilling water on the cigars in the humidor is unnecessarily present. Furthermore, it is necessary to re-hydrate these types of materials more frequently than many cigar enthusiasts actually do. As a result, if a user fails to timely re-hydrate his or her moisture releasing material, his or her cigars may dry out and become undesirably brittle. Additionally, it is difficult for users to determine when these moisture releasing materials are in need of re-hydration, thereby necessitating the use of an expensive gauge commonly referred to as a hygrometer. Another problem with devices that employ these materials is that they do not regulate relative humidity but merely uncontrollably release water vapor in the cigar box or humidor. As a result, these devices do not have the ability to decrease the relative humidity, when necessary, thereby undesirably increasing the risk of mold and mildew.

One method for attempting to regulate humidity is to add propylene glycol (commonly referred to as "PG") to a moisture releasing material. Propylene glycol is a hydrostatic liquid that absorbs moisture when the relative humidity goes over 70% and allows evaporation of water when the relative humidity drops below 70%. Conventional devices that employ propylene glycol require the user to maintain the proper ratio of water to propylene glycol within the humidification device. Moreover, the propylene glycol content in the device can easily be washed out during the re-hydration process. That is, when water is poured into a moisture releasing material that is impregnated or partially saturated with propylene glycol, any water that drips or runs out will carry with it some of the propylene glycol. After this happens repeatedly, as it commonly does during the refilling process, the propylene glycol is either totally removed by rinsing action or is so depleted that it no longer adequately functions to stabilize the local relative humidity.

Also, propylene glycol solutions, often referred to as "50/50" solutions because they typically contain 50% propylene glycol and 50% distilled water, have been used in place of pure propylene glycol, which suffers from the aforementioned disadvantages when used with conventional moisture releasing materials, e.g., open-cell foam. However, if these components are not properly mixed prior to their addition to the moisture releasing material, the same inconsistent maintenance of relative humidity results.

Furthermore, when reusing ceramic blocks or oasis/floral materials for an extended duration, the pores of the materials become clogged with potentially dangerous organic growths such as mold, spores, and mildew, adding a potential health risk, even if propylene glycol is employed.

Therefore, the need exists for a humidity control device that has the ability to regulate the relative humidity in a humidor, minimize the risk of cigar wetting, minimize the depletion of valuable space within the volume to be humidified, that is simple to manufacture and easy to use.

SUMMARY OF THE INVENTION

In one embodiment, the present invention is directed to an apparatus, preferably a portable and transferable apparatus, for controlling a humidity level within an enclosed volume storage device, including but not limited to cigar humidors, comprising a container having outer walls defining an inner volume, at least one of the outer walls having perforations therein; and a composition capable of adsorbing and desorbing water and contained in the inner volume of the container, wherein the composition is hydrated to a hydration level less than about 0.13 mL water per gram of the composition. Optionally, the hydration level is from about 0.071 to about 0.13 mL water, e.g., from about 0.085 to about 0.11 mL water, per gram of the composition. The apparatus preferably maintains a predetermined humidity level within the storage device.

Optionally, the container is formed of a substantially rigid material, such as, for example, a propionate material, such as those manufactured by LaCons also known as LA Packaging, 24895 E. La Palma Ave., Yorba Linda, Calif., 92887 USA. Exemplary materials for the container include those designated as part numbers 260430 & 260900 sold under the trade name NUCONS®. Optionally, the container comprises a removable perforated lid secured to a base. Possible materials for the container include but are not limited to polyethylene, clarified polyethylene, polypropylene, clarified polypropylene, extrusion blow-moldable copolyester, polycarbonate, propionate, polymers, plastics, resins, composites or lightweight metal.

Optionally, the apparatus further comprises a moisture-absorbent foam element or a porous material disposed between the composition and the perforated wall of the container. In this aspect, the composition that is capable of adsorbing and desorbing water may be hydrated by adding water directly to the moisture-absorbent foam or porous material. The water is then transferred though the moisture-absorbent foam or porous material to the composition. A non-limiting list of exemplary porous materials includes textile, cloth, netting, mesh screen, polyurethane, sponges (natural or synthetic), and metal fabric.

Optionally, the apparatus further comprises a porous retaining element disposed between the composition and the perforations. The retaining element is particularly suited for retaining the composition in the apparatus in embodiments in which the perforations are directed in a downward direction. In this aspect, the porous retaining element preferably has an average pore diameter that is less than about 1000 μm, e.g., less than about 500 μm, less than about 300 μm, less than about 100 μm, less than about 50 μm, less than about 1 μm or less than about 0.5 μm. In terms of upper limits, optionally in combination with any of these lower limits, the average pore diameter optionally is greater than about 0.5 μm, greater than about 50 μm, greater than about 100 μm, or greater than about 500 μm.

The apparatuses of the present invention can be made in various shapes and sizes and can be put to various uses, including being mounted into a humidor and/or the surface area of the container exposed to the interior of the humidor can be varied by mechanical means and easily transferable to various humidors or containers. Optionally, the container is in the form of a cylindrical disc, triangular prism, tetragonal prism, pentagonal prism, hexagonal prism, septagonal prism, octagonal prism, or other form. In one embodiment, the container has a cylindrical form and generally resembles a cigar or cigarette in geometry so as to fit easily in a humidor containing cigars and/or cigarettes, respectively. In this aspect, the container optionally has a diameter and a longitudinal length, and the longitudinal length is at least 4 times, e.g., at least 6 times, at least 8 times, at least 10 times or at least 15 times, greater than the diameter.

Optionally, at least one of the walls is formed of a porous textile, e.g., non-woven, non-perforated sheet made by spinning extremely fine continuous high-density polyethylene (HDPE) fibers that are fused together to form a strong uniform web high density polyethylene, such as TYVEK®, manufactured by E.I. du Pont de Nemours and Company, Gorilla Wrap™, manufactured by Johns Manville of Denver, Colo., or PINKWRAP®, manufactured by Owens Corning of Toledo, Ohio.

In another embodiment, the invention is to an enclosed volume storage device, comprising a base portion comprising one or more outer side walls and a bottom wall defining an inner volume and having a top opening; and a removable lid portion that is securable to the base portion about the top opening, the lid portion comprising a first exterior nonporous major planar surface, and a second interior porous major planar surface, and a composition capable of adsorbing and desorbing water disposed between the first and second major planar surfaces. The composition preferably is hydrated to a hydration level less than about 0.13 mL water per gram of the composition. Optionally, the hydration level is from about 0.071 to about 0.13 mL water, e.g., from about 0.085 to about 0.11 mL water, per gram of the composition. The apparatus preferably maintains a predetermined humidity level within the storage device.

In another embodiment, the invention is to an apparatus for controlling a humidity level within an enclosed volume storage device, comprising a first sheet of a first porous material, including but not limited to a porous textile, e.g., non-woven, non-perforated sheet made by spinning extremely fine continuous high-density polyethylene (HDPE) fibers that are fused together to form a strong uniform web high density polyethylene, such as TYVEK®, manufactured by E.I. du Pont de Nemours and Company, Gorilla Wrap™, manufactured by Johns Manville of Denver, Colo., or PINKWRAP®, manufactured by Owens Corning of Toledo, Ohio, having a first peripheral edge; a second sheet of a second porous material, including but not limited to a porous textile, e.g., non-woven, non-perforated sheet made by spinning extremely fine continuous high-density polyethylene (HDPE) fibers that are fused together to form a strong uniform web high density polyethylene, such as TYVEK®, manufactured by E.I. du Pont de Nemours and Company, Gorilla Wrap™, manufactured by Johns Manville of Denver, Colo., or PINKWRAP®, manufactured by Owens Corning of Toledo, Ohio, having a second peripheral edge attached to the first sheet about the first peripheral edge; and a composition capable of adsorbing and desorbing water disposed between the first and second sheets. The composition is preferably hydrated to a hydration level less than about 0.13 mL water per gram of the composition. Optionally, the hydration level is from about 0.071 to about 0.13 mL water, e.g., from about 0.085 to about 0.11 mL water, per gram of the composition. The apparatus preferably maintains a predetermined humidity level within the storage device. In this aspect, the first porous material may be of the same or a different type of material as the second porous material. This embodiment is particularly suited for being secured to a lid of the enclosed volume storage device.

In another embodiment, the invention is to a method for controlling a humidity level within an enclosed volume storage device, comprising: (a) providing a container having outer walls defining an inner volume, at least one of the outer walls having perforations therein, wherein the container contains a composition capable of adsorbing and desorbing water in the inner volume; (b) hydrating the composition to a hydration level less than about 0.13 mL water per gram of the composition; and (c) situating the container in the enclosed volume storage device. Optionally, the hydration level is from about 0.071 to about 0.13 mL, e.g., from about 0.085 to about 0.11 mL water per grain of the composition. The process optionally further comprises maintaining a predetermined humidity level within the storage device. Additionally or alternatively, the container comprises a removable perforated lid secured to a base, and the process further comprises securing the lid to the base after the hydrating step.

In the various above embodiments, the composition preferably comprises silica and/or amorphous silica and/or a material selected from the group consisting of silicic acid; Amorphous Silicon Dioxide, Lithium Chloride whose ingredients comprise Silica, Amorphous (SiO), Lithium Chloride (LiCl), and combinations thereof. The composition optionally comprises ARTSORB® sold by Fuji Silysia, 2-1846 Kozoji-cho, Kasugai-shi, Aichi-ken, JAPAN 487-0013 and manufactured by Fuji Silysia, P.O. Box 14434, Research Triangle Park, N.C. 27709, USA. One pound of ARTSORB® can maintain a precise relative humidity for approximately 5 cubic feet, and is completely nontoxic, has no odor, and does not drip. Suitable substitute materials are sold under the trade names ARTEN® and RHAPIDGEL® sold by Art Preservation Services, 315 East 89th Street New York, N.Y. 10128, and PROSORB® sold by Medical & Technical Research Associates, Inc., 2320 Scientific Park Drive, Wilmington, N.C. Preferably, the composition, prior to hydration, is provided in granular form and is designed to maintain a "substantially constant relative humidity," defined herein as a targeted or desired relative humidity (RH) level ±10% (and more preferably ±5%, ±2% or ±1%). Specific preferred targeted or desired humidity levels include about 50% RH, about 55% RH, about 60% RH, about 65% RH and about 70% RH. Desirably, a small amount of the granular material placed within the container will maintain a substantially constant relative humidity.

In accordance with these and other objects, which will become apparent hereinafter, the instant invention will now be described with particular reference to the accompanying drawings.

BRIEF DESCRIPTION OF THE DRAWINGS

The present invention will be better understood with referenced to the appended non-limiting figures, wherein.

DETAILED DESCRIPTION OF THE INVENTION

Figure 1:
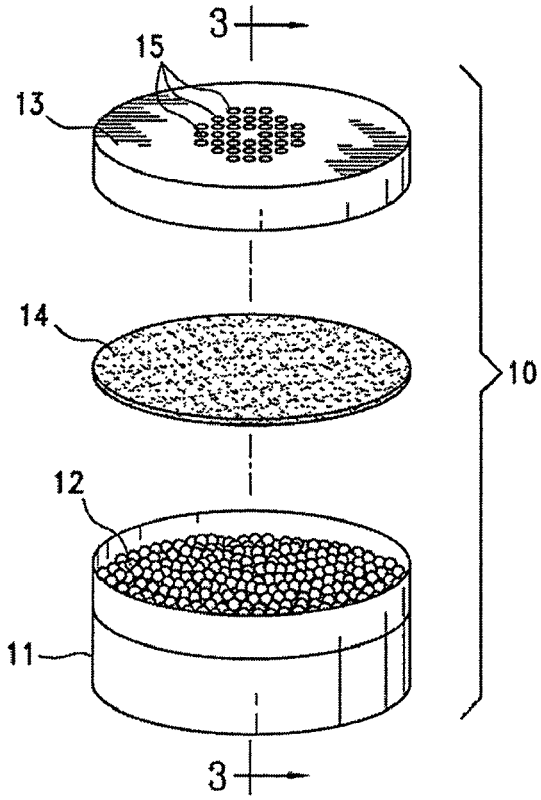
FIG. 1 is a perspective, partially exploded, view of a first embodiment of the present invention.

The invention is directed to various apparatuses and methods for maintaining a substantially constant relative humidity in an enclosed volume storage device. As used herein, the term "substantially constant relative humidity" means a targeted or desired relative humidity (RH) level(s) ±10% (and more preferably ±5%, ±2% or ±1%). Specific preferred targeted or desired humidity levels include about 50% RH, about 55% RH, about 60% RH, about 65% RH and about 70% RH. "Relative humidity" is defined as the ratio of the partial pressure of water vapor in a gaseous mixture of air and water to the saturated vapor pressure of water at a given temperature, room temperature for purposes of the present specification. Relative humidity is expressed as a percentage and is calculated based on the following equation.

$$RH = \frac{\rho_{H_2O}}{\rho^*_{H_2O}} \times 100\%$$

wherein:

RH is the relative humidity of the gas mixture being considered;

$\rho_{H_2O}$ is the partial pressure of water vapor in the gas mixture; and $\rho^*_{H_2O}$ is the saturation vapor pressure of water at the temperature of the gas mixture.

In one embodiment, the present invention is directed to an apparatus for controlling a humidity level within an enclosed volume storage device, including but not limited to cigar humidors. The apparatus includes a container having outer walls defining an inner volume, at least one of the outer walls having perforations therein. The apparatus also includes a composition capable of adsorbing and desorbing water and contained in the inner volume of the container. In one embodiment, the composition is hydrated to a hydration level of less than about 0.13 mL water per gram of the composition. Optionally, the hydration level is from about 0.071 to about 0.13 mL water, e.g., from about 0.085 to about 0.11 mL water, per gram of the composition. Optionally, in various embodiments, the composition is hydrated to a hydration level of less than about 99%, less than about 90%, less than about 80%, less than about 70%, less than about 60% or less than about 50%. In terms of ranges, the hydration level optionally is from about 25% to about 90% saturation, e.g., from about 25% to about 50%, from about 50% to about 90%, from about 40% to about 85%, from about 60% to about 80%, or from about 40% to about 60% saturation. In this context, the term "hydrated" means that liquid water is added to the composition until the desired hydration level is achieved, as opposed to over-hydrating or saturating the composition and allowing the over-hydrated or saturated composition to dehydrate, e.g., over time, to the desired hydration level. It has been found that by hydrating the composition to these levels, and without over-hydrating or saturating the composition, the composition provides improved characteristics for regulating humidity in the storage device. Specifically, by hydrating the composition to (but without exceeding) the above-described hydration levels, the composition is substantially more capable of dehumidifying (adsorbing water vapor), if necessary, in addition to humidifying (desorbing water vapor) in order to maintain a substantially constant relative humidity in the enclosed volume storage device. In this manner, the apparatus preferably maintains a substantially constant relative humidity within the enclosed volume storage device. In contrast, compositions that are fully saturated undesirably are not capable of adsorbing additional water vapor.

The type of enclosed volume storage device may vary widely. A non-limiting list of exemplary enclosed volume storage devices includes tobacco storage devices, e.g., cigar humidors, cigar boxes, smokeless tobacco storage devices, pipe tobacco storage devices and tobacco containers. In various other embodiments, the storage device may comprise a cooler, wine chiller, wine storage device, humidification jar, ammunition storage device, travel humidor, cabinet humidor (e.g., to even out humidity on multiple levels), countertop displays, etc. In additional optional embodiments, the enclosed volume storage device may be used for storing sports equipment (e.g., baseballs, footballs, soccer balls, or protection equipment such as protective padding, helmets, etc.), clothing, sports memorabilia, film, photographic supplies, art, art supplies, paints, artifacts, or motion pictures. In other exemplary embodiments, the device is for storing one or more consumer products, such as, food products, electronics, musical instruments, or electronic devices and instruments. Such products typically desire RH ranges of from about 45% to about 55% RH, from about 55% to about 65% RH, from about 65% to about 75% RH or from about 75% to about 85% RH.

Optionally, the container, optionally a portion thereof, is formed of a substantially rigid material, such as, for example, a propionate material, such as those manufactured by LaCons also known as LA Packaging, 24895 E. La Palma Ave., Yorba Linda, Calif., 92887 USA. Exemplary materials for the container include those designated as part numbers 260430 & 260900 sold under the trade name NUCONS®. Possible materials for the container include but are not limited to polyethylene, clarified polyethylene, polypropylene, clarified polypropylene, extrusion blow-moldable copolyester, polycarbonate, propionate, polymers, plastics, resins, composites or lightweight metal.

In a preferred embodiment, the container, or a portion thereof, is formed of a transparent material such as clarified polypropylene, which permits an individual to view the composition contained in the apparatus. As discussed in more detail below, the composition preferably comprises a material that reflects its hydration level by its color. For example, the composition may appear substantially clear, i.e., transparent, when properly hydrated, but may exhibit an opaque white to grayish hue when it is under hydrated, meaning in need of hydration. Forming the container, or a portion thereof, of a transparent material thereby facilitates determining whether the apparatus is properly hydrated or in need of hydrating.

The orientation, size and shape of the perforations may vary widely. In one aspect, the perforations are in the lid of the container. Additionally or alternatively, the perforations are on the side wall or walls of the container. Additionally or alternatively, the perforations are on the bottom of the container. If no retaining member is employed, the perorations preferably are smaller than the average size of the composition so as to minimize spillage of the composition through the perforations as the container is moved about. In this aspect, the average size of the perforations optionally is less than about 1000 μm, less than about 500 μm or less than about 100 μm. When a retaining member is employed, larger perforations may be desired. For example, the average size of the perforations may be, for example, from about 0.5 mm to about 5 mm, e.g., from about 1 to about 5 mm, or from about 2 to about 4 mm. The shape or shapes of the perforations also may vary widely. For example, the perforations may be circular, triangular, square, star shaped, diamonds, slots, etc., or a combination thereof. In one embodiment, the size of the perforations are variable with a mechanical device so as to vary the surface area of the container that is exposed to the interior of the storage device. This may be achieved, for example, by employing a fixed perforated plate and a second overlapping moveable perforated plate. The aperture size of the perforations formed by the overlapping plates can be increased or decreased as the moveable plate covers or uncovers the perforations of the fixed perforated plate.

The shape of the container may vary widely depending, for example, on the type of storage device in need of humidity regulation. In various embodiments, the apparatuses of the present invention can be made in various shapes and sizes and can be put to various uses, including being mounted into a humidor. Optionally, the container is in the form of a cylindrical disc, triangular prism, tetragonal prism, pentagonal prism, hexagonal prism, septagonal prism, octagonal prism, or other form. In one embodiment, the container has a cylindrical form and generally resembles a cigar or cigarette in geometry so as to fit easily in a humidor containing cigars and/or cigarettes, respectively. In this aspect, the container optionally has a diameter and a longitudinal length, and the longitudinal length is at least 4 times, e.g., at least 6 times, at least 8 times, at least 10 times or at least 15 times, greater than the diameter. In this aspect, either or both of the respective ends of the container may be removable and/or porous (or have openings therein). Optionally, the side wall(s) of the container are porous or have openings therein in order to allow water vapor to enter and exit the container as needed.

In some aspects, the container comprises a removable lid that is secured to a base. In this aspect, the base preferably has a bottom wall and one or more side walls disposed around the edges of the bottom wall. Preferably, the upper edge of the one or more side walls forms a lip, which optionally is threaded, capable of removably interacting with the lid. Optionally, the lid also has threads for engaging the optional threads on the lip, as is well known in the art. The lid optionally is porous or has perforations therein, which allow water vapor to pass into and out of the container, as necessary to regulate the humidity of the storage device.

In another aspect, the lid is intended to be removed when in normal operation. In this aspect, the lid preferably is non-porous and does not have perforations therein. In this aspect, the top of the container is removed prior to use, and the topless container is positioned inside the storage container on a flat surface thereof. The container rests on its bottom wall within the storage container, and the composition stays in the container due to gravity. This embodiment desirably maximizes the surface area of the composition inside the container that is exposed to the inner volume of the storage container.

In one aspect, the apparatus further comprises a moisture-absorbent foam element or a porous material disposed between the composition and the perforated wall of the container. In this aspect, the composition that is capable of adsorbing and desorbing water may be hydrated by adding water directly to the moisture-absorbent foam or porous material. The water is then transferred, e.g., through osmosis, through the moisture-absorbent foam or porous material to the composition as needed. A non-limiting list of exemplary porous materials includes textile, cloth, netting, mesh screen, polyurethane, sponges (natural or synthetic), and metal fabric. In addition, the foam or porous material also may act as a retaining element, discussed below. If moisture-absorbent foam is employed, it optionally comprises polyurethane having a density of from about 0.025 to about 4.0 pounds/foot$^3$ (0.4-64 kg/m$^3$).

Optionally, the apparatus further comprises a porous retaining element disposed between the composition and the perforations. Upon direct hydration, some of the composition may fracture, which does not affect the moisture sensitive silica media's ability to regulate relative humidity, but which may reduce the size of the composition particles. The retaining element preferably minimizes loss of such fractured composition particles in addition to non-fractured composition particles. Also, in one aspect of the invention, described below with reference to FIG. 2, the apparatus is secured, e.g., removable secured such as with a magnet or Velcro, to the lid of the storage device such that the perforations in the container are directed in a downward direction when the lid of the storage device is in a closed position. In this aspect, if the perforations are too large, and/or if the composition comprises beads that are too small, the composition contained in the apparatus may undesirably fall through the perforations and into the storage device. Positioning a retaining element between the composition and the perforations in the container is particularly desirable for retaining the composition in the apparatus in these embodiments. The retaining element may be secured (e.g., by glue, rubber cement, stitching, etc.) to one or more of the container walls, to the container lid (e.g., to the peripheral lip or edge around the lid), or to the container walls (e.g., to the peripheral lip or edge around the side wall(s)). Alternatively, the retaining element is simply positioned between the lid and the composition, and the pressure between the lid and the underlying composition causes the retaining element to stay substantially in place therebetween.

The pores in the retaining element should be small enough to prevent or inhibit the composition from passing through the pores, yet be large enough to easily allow water vapor to pass through the pores. In some exemplary embodiments, the porous retaining element has an average pore size (e.g., diameter) that is less than about 1000 μm, e.g., less than about 500 μm, less than about 300 μm, less than about 100 μm, less than about 50 μm, less than about 1 μm or less than about 0.5 μm. In terms of upper limits, optionally in combination with any of these lower limits, the average pore size (e.g., diameter) optionally is greater than about 0.5 μm, greater than about 50 μm, greater than about 100 μm, or greater than about 500 μm. The retaining member may be formed of a variety of porous materials such as, for example, textile, cloth, netting, mesh screen, polyurethane, sponges (natural or synthetic), metal fabric, or any of the above-described materials listed with respect to exemplary porous materials. The density of the retaining member optionally is from about 0.5 to about 3.0 pounds/ft$^3$ (about 8 to about 48 kg/m$^3$), e.g., from about 1.0 to about 2.0 pounds/ft$^3$ (about 16 to about 32 kg/m$^3$) or from about 1.3 to about 1.9 pounds/ft$^3$ (about 20 to about 30 kg/m$^3$), and preferably about 1.6 pounds/ft$^3$ (about 26 kg/m$^3$).

In some aspects, the retaining element may have smaller pores so long as the pores are large enough allow water vapor to pass there through, e.g., having pores having an average pore size of less than about 20 μm, e.g., less than about 10 μm or less than about 5 μm, but larger than about 2 μm. For example, the retaining element optionally comprises expanded polytetrafluoroethylene (ePTFE) (e.g., GORE-TEX®, see U.S. Pat. Nos. 3,953,566 and 4,194,041, the entireties of which are incorporated herein by reference). Alternative retaining elements may be comprised of a non-woven, non-perforated sheet made by spinning extremely fine continuous high-density polyethylene (HDPE) fibers that are fused together to form a strong uniform web high density polyethylene, such as TYVEK®, manufactured by E.I. du Pont de Nemours and Company, Gorilla Wrap™, manufactured by Johns Manville of Denver, Colo., or PINKWRAP®, manufactured by Owens Corning of Toledo, Ohio.

In the various above embodiments, the apparatuses and method employ a composition capable of adsorbing and desorbing water. Preferably, the composition comprises silica, e.g., amorphous silica. Optionally, the composition comprises (in addition to or as an alternative to silica) a material selected from the group consisting of silicic acid; Amorphous Silicon Dioxide, Lithium Chloride whose ingredients consist of Silica, Amorphous (SiO), Lithium Chloride (LiCl), and combinations thereof. The composition optionally comprises ARTSORB® sold by Fuji Silysia, 2-1846 Kozoji-cho, Kasugai-shi, Aichi-ken, JAPAN 487-0013 and manufactured by Fuji Silysia, P.O. Box 14434, Research Triangle Park, N.C. 27709, USA. One pound of ARTSORB® can maintain a precise relative humidity for approximately 5 cubic feet, and is nontoxic, has no odor, and does not drip. In various alternative embodiments, the compositions comprises one or more materials sold under the trade names ARTEN® and RHAPIDGEL® sold by Art Preservation Services, 315 East 89th Street New York, N.Y. 10128, and PROSORB® sold by Medical & Technical Research Associates, Inc., 2320 Scientific Park Drive, Wilmington, N.C. Preferably, the composition is provided in granular form and is designed to maintain a substantially constant relative humidity, defined above. Desirably, a small amount of the granular material placed within the container will maintain a substantially constant relative humidity. The average particle size of the granular composition is preferably on the order of from about 0.5 mm to about 5 mm, e.g., from about 1 mm to about 4 mm, or from about 2 mm to about 3 mm.

In a preferred embodiment, the composition changes color as its hydration level changes, thereby making it easy for an individual to determine whether the composition is in need of hydration or re-hydration. For example, the composition (e.g., ARTSORB®) may appear substantially clear, i.e., transparent, when properly hydrated, but may exhibit an opaque white or grayish hue when it is under hydrated, meaning in need of hydration. Thus, the need for re-hydration of the composition may be determined through visual inspection of the composition, if the composition changes color when under hydrated. The need for re-hydration also may be determined with a hygrometer, a device used to measure relative humidity. Re-hydration of the composition may be desired, for example, when the level of relative humidity in the closed container falls outside of the substantially constant relative humidity range.

Hydrating or re-hydrating the composition is fairly simple. In a preferred embodiment, distilled and/or de-ionized water is simply added to the composition in an amount sufficient to cause the composition to have the desired hydration level (described above). Ideally, the composition is substantially if not fully dehydrated prior to its first use, and an individual can hydrate the device for its first use by adding a specifically measured volume of distilled and/or de-ionized water. The amount of water'necessary to properly hydrate the composition for its first use will, of course, vary depending on the volume and type of composition that is employed in the apparatus. As some non-limiting examples, for first use, from about from about 0.071 to about 0.13 mL water, e.g., from about 0.085 to about 0.11 mL water, is added to the "dry" composition for every grain of "dry" composition in order to provide a composition that is hydrated to a desired hydration level. In various embodiments, the composition is hydrated to a hydration level of less than about 99%, less than about 90%, less than about 80%, less than about 70%, less than about 60% or less than about 50%. In terms of ranges, the hydration level optionally is from about 25% to about 90% saturation, e.g., from about 25% to about 50%, from about 50% to about 90%, from about 40% to about 85%, from about 60% to about 80%, or from about 40% to about 60% saturation. Typically, a smaller amount of water is added to the composition when (and if) it is desired to re-hydrate the composition.

If the composition employed becomes transparent when properly hydrated, as discussed above, the minimum amount of water necessary to make the composition become substantially transparent preferably is used when re-hydrating the composition. In some aspects, the optimum saturation level of the composition is from about 50 to about 90% of the volume of composition being hydrated. Importantly, the hydration process preferably does not require the addition of propylene glycol or any chemicals or compositions except for water.

Preferably, the composition has been selected for its ability to maintain a specific substantially constant relative humidity level, as defined above. The target humidity level may vary depending, for example, on what is being stored in the storage device. If the storage device comprises a humidor, the targeted relative humidity level preferably is from about 60% to about 72%, e.g., about 60%, about 61%, about 62%, about 63%, about 64%, about 65%, about 66%, about 66%, about 67%, about 68%, about 69%, about 70%, about 71% or about 72%. Thus, if the composition is selected for its ability to maintain a humidification level of 72%, in order to maintain a substantially constant relative humidity level of 72%, the composition should be able to maintain a humidity level of 72%±10% (and more preferably ±5%, ±2% or ±1%), regardless of the ambient humidity (meaning at ambient humidity levels between 0% and 100%). Of course, other target humidity levels may be employed for the storage of other items.

In another embodiment, the invention is to an enclosed volume storage device, which includes a base portion comprising one or more outer side walls and a bottom wall defining an inner volume and having a top opening. The device also includes a lid portion that is removable and securable to the base portion about the top opening. The lid portion comprises a first exterior nonporous major planar surface, and a second interior porous major planar surface. A composition capable of adsorbing and desorbing water, as described above, is disposed between the first and second major planar surfaces. The composition may be any of the above-described compositions, and, accordingly, preferably is hydrated to a hydration level less than about 0.13 mL water per gram of the composition. Optionally, the hydration level is from about 0.071 to about 0.13 mL water, e.g., from about 0.085 to about 0.11 mL water, per gram of the composition. In various embodiments, the composition is hydrated to a hydration level of less than about 99%, less than about 90%, less than about 80%, less than about 70%, less than about 60% or less than about 50%. In terms of ranges, the hydration level optionally is from about 25% to about 90% saturation, e.g., from about 25% to about 50%, from about 50% to about 90%, from about 40% to about 85%, from about 60% to about 80%, or from about 40% to about 60% saturation. The apparatus preferably maintains a substantially constant relative humidity level within the storage device.

In another embodiment, the invention is to an apparatus for controlling a humidity level within an enclosed volume storage device, comprising a first sheet of a first porous material having a first peripheral edge and a second sheet of a second porous material having a second peripheral edge attached to the first sheet about the first peripheral edge, for example, by stitching, glue, adhesive, clamps, or similar material. The material selected for the first and/or second sheets (the first and second porous materials, respectively) may be any material identified above with respect to possible materials that are suitable for retaining elements. The apparatus further comprises a composition, as described above, capable of adsorbing and desorbing water disposed between the first and second sheets. The composition preferably is hydrated to a hydration level less than about 0.13 mL water per gram of the composition. Optionally, the hydration level is from about 0.071 to about 0.13 mL water, e.g., from about 0.085 to about 0.11 mL water, per gram of the composition. The apparatus preferably maintains a substantially constant relative humidity level within the storage device. In this aspect, the first porous material may be of the same or a different type of material as the second porous material. In an alternative embodiment, one of the two sheets, but not both, is formed of a porous material, and the other sheet is substantially non-porous, meaning non-porous to water. This embodiment is particularly suited for being secured to a lid of the enclosed volume storage device, and in particular for a storage device for smokeless tobacco products. In this aspect, the lid preferably comprises a non-porous major planar surface, and the apparatus optionally covers at least about 50%, at least about 75%, at least about 90% or at least about 95% of the surface of the non-porous major planar surface.

Optionally, one or more of the walls (e.g., the lid, the side wall or walls and/or the bottom wall) of the apparatus is formed of a foam element or a porous material, as described above. In various exemplary embodiments, the foam element or porous material comprises a textile, cloth, netting, mesh screen, metal fabric, polyurethane, or a sponge material (natural or synthetic). If a textile is employed, the container may be in the form of a fabric satchel. For example, in one aspect, the method comprises a first step of providing cloth or fabric satchel having a closed-off end and defining an inner volume. A composition capable of adsorbing and desorbing water is disposed within the inner volume. In this aspect, the perforations may comprise pores in the textile which are not readily visible to the eye. This embodiment is desirable because the pores are sufficient small such that the composition will not move through them, even in the absence of a separate retaining member. In one embodiment, the apparatus comprises a small satchel of a single piece of porous material that surrounds or wraps the composition that is capable of adsorbing and desorbing water. A piece of string, ribbon, fabric, or similar material may be tied around the single piece of porous material so that it adequately holds the composition therein. In another aspect, the satchel may be stitched closed.

In another embodiment, the apparatus comprises a spherical container, e.g., ball, having perforations therein. The container contains a quantity of a composition capable of adsorbing or desorbing water, as described above. Optionally, the container has an offset weight secured thereto so as to selectively position the ball in a certain position, e.g., a position in which the perforations are disposed above the composition contained in the container. In other embodiments, the apparatus is in the shape of a cube, cylindrical tube, ball, fabric cigar shape, rectangular box, or disc. In these aspects, the apparatus may be formed of fabric, metal and/or plastic.

In one aspect, the apparatus includes a hygrometer, optionally a digital hygrometer, attached thereto or otherwise incorporated therein.

In another embodiment, the invention is to a method for controlling a humidity level within an enclosed volume storage device using any of the above-described apparatuses. For example, in one aspect, the method comprises a first step of providing a container having outer walls defining an inner volume, at least one of the outer walls having perforations therein, wherein the container contains a composition capable of adsorbing and desorbing water in the inner volume. Alternatively, the method comprises a first step of a providing an apparatus comprising a base portion comprising one or more outer side walls and a bottom wall defining an inner volume and having a top opening, and a lid portion removable and securable to the base portion about the top opening, the lid portion comprising a first exterior nonporous major planar surface, and a second interior porous major planar surface, and a composition capable of adsorbing and desorbing water disposed between the first and second major planar surfaces. Alternatively, the method comprises a first step of providing an apparatus for controlling a humidity level within an enclosed volume storage device, the apparatus comprising a first sheet of a first porous material having a first peripheral edge, a second sheet of a second porous material having a second peripheral edge attached to the first sheet about the first peripheral edge, and a composition capable of adsorbing and desorbing water disposed between the first and second sheets. Alternatively, the method comprises a first step of providing cloth or fabric satchel having a closed-off end and define an inner volume, and a composition capable of adsorbing and desorbing water disposed within the inner volume.

Regardless of which apparatus is employed, the method preferably further comprises a steps of hydrating the composition to a hydration level less than about 0.13 mL water per gram of the composition, and optionally situating the container in the enclosed volume storage device. Optionally, the hydration level is from about 0.071 to about 0.13 mL water, e.g., from about 0.085 to about 0.11 mL water, per grain of the composition. In various embodiments, the composition optionally is hydrated to a hydration level of less than about 99%, less than about 90%, less than about 80%, less than about 70%, less than about 60% or less than about 50% saturation. In terms of ranges, the hydration level optionally is from about 25% to about 90% saturation, e.g., from about 25% to about 50%, from about 50% to about 90%, from about 40% to about 85%, from about 60% to about 80%, or from about 40% to about 60% saturation. The process optionally further comprises maintaining a predetermined humidity level within the storage device. In one embodiment, the container further comprises a perforated lid removably secured to a base, and the process further comprises securing the lid to the base after the hydrating step.

For those embodiments in which the storage device is intended for the storage of consumer products, the composition, retaining material (if present), and other components of the apparatus preferably satisfies the requirements of the FDA (Food and Drug Administration) to be placed in the same containers as consumer products.

Referring now to FIG. 1, humidification regulating apparatus 10 is shown in exploded perspective view. As shown, apparatus 10 comprises a cylindrical container (base) 11, and is adapted to house a quantity of a composition 12 that is capable of adsorbing and desorbing water. As shown, the composition 12 comprises a moisture-sensitive silica material, as described above. The container is preferably closed at one end (its "bottom" side, not visible) and is provided with a removable closure element such as lid 13 having perforations 15 at the other end. Lid 13 has a circumference slightly larger than the circumference of the peripheral edge of the container 11 so as to overlap the container (base) 11 in a substantially sealing engagement about end opening of the container 11. In an alternative embodiment, not shown, the lid is threadingly engaged with threads on the peripheral region of the upper edge of the walls of container 11.

Figure 2:
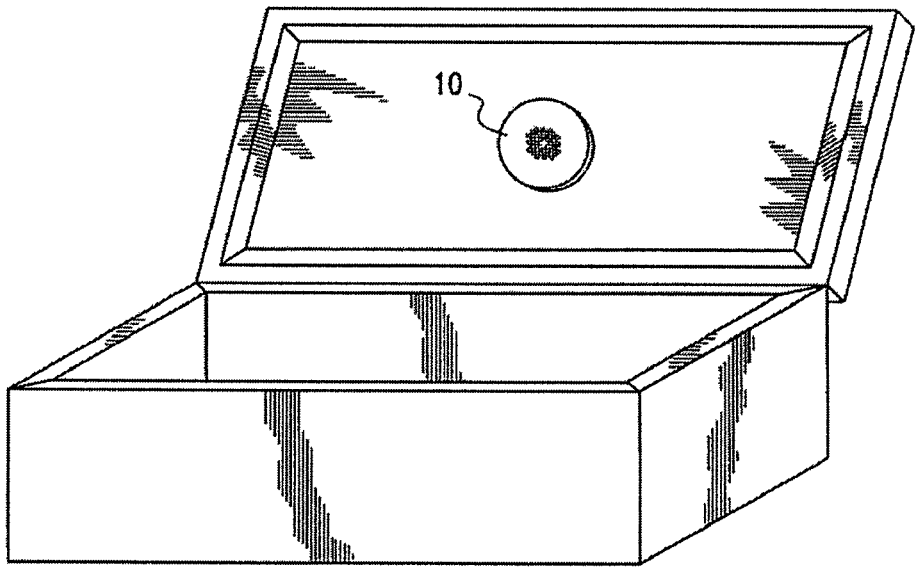
FIG. 2 is a perspective view of a humidor showing one application of the exemplary device of the present invention.

Apparatus 10 also comprises a retaining member 14, such as a porous cloth, porous urethane, or a sponge, which acts to inhibit transfer of the composition 12 through perforations 15 when the apparatus 10 is inverted (for example, if the "bottom" of the apparatus 10 is removably attached to the underside of a closed lid of a storage device (e.g., humidor), as shown in FIG. 2, discussed below).

The composition 12 controls relative humidity to a predetermined level, as described above, through absorbing or desorbing water vapor through the perforations 15 in lid 13. If a greater desorption is desired, the moisture-sensitive silica material 12 can be moistened through direct hydration by removing lid 13 and retaining member 14 or by absorbing moisture from a directly hydrated retaining member 14.

Container 10 is comprised, at least in part, of a material which is lightweight and has a means of allowing the composition 12 to absorb and desorb water (e.g., as water vapor), preferably through perforations 15 in the lid 13. The perforations 15 in the lid 13 should be of a size and shape that would allow adequate flow of water vapor to pass therethrough at a rate, which will maintain the predetermined relative humidity level within the container 10. The rate of absorption and desorption will depend upon the perforation size and pattern, as well as the volume of the composition 12 within the container 10.

The embodiment shown in FIG. 1 may be simply placed within a storage device such as a cigar box or humidor, or other environment wherein humidity regulation is desired. In one aspect, the apparatus 10 (specifically, the bottom of container 11) is affixed, optionally removably affixed, to the interior surface of the lid of a cigar box or humidor, as shown in FIG. 2, using a securing device, such as a magnet or hook and loop fabric, such the fabric sold under the trademark VELCRO®. It has been determined that an apparatus 10 having a diameter between ⅛ inches and 8 inches in length and between ⅛ inches and 8 inches in diameter, containing the composition 12 capable of adsorbing or desorbing water, will maintain the humidity level to a predetermined level, for a virtual indefinite amount of time, depending on known factors that affect relative humidity such as ambient temperature and how often the enclosed volume of the storage device is exposed to outside relative humidity levels that differ from the interior level. This period is substantially longer than the period of time in which adequate humidification is provided by standard ceramic block or open-cell foam humidifiers, which typically are in need of recharging every two to four weeks.

Figure 3:
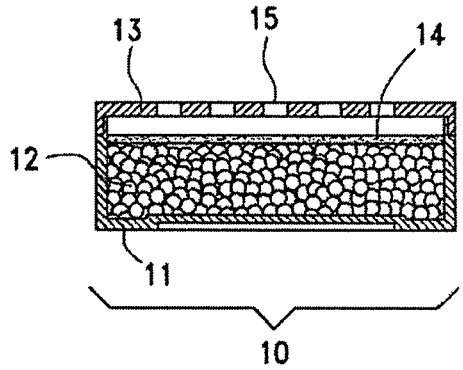
FIG. 3 is a cross-sectional view of the application of one embodiment of the present invention shown in FIG. 1, taken along lines 3-3.

FIG. 3 is a cross-section of the embodiment shown in FIG. 1, taken along line 3-3. The embodiment shown is comprised of container 10, which is shown closed at one end (bottom) and is provided with a removable closure element such as lid 13 having perforations 15 at the other. The lid 13 is adapted to have an overlapping relationship with the upper peripheral edge of the container (base) 11 in a substantially sealing engagement about end opening of the container 11 of the apparatus 10.

The composition 12 capable of adsorbing and desorbing water controls relative humidity to a predetermined level through absorbing or desorbing water vapor through the perforations 15 in the lid 13. If a greater desorption is desired, the composition 12 can be moistened through direct hydration by removing the lid 13 and retaining member 14 or by absorbing moisture from a directly hydrated retaining member 14.

Figure 4:
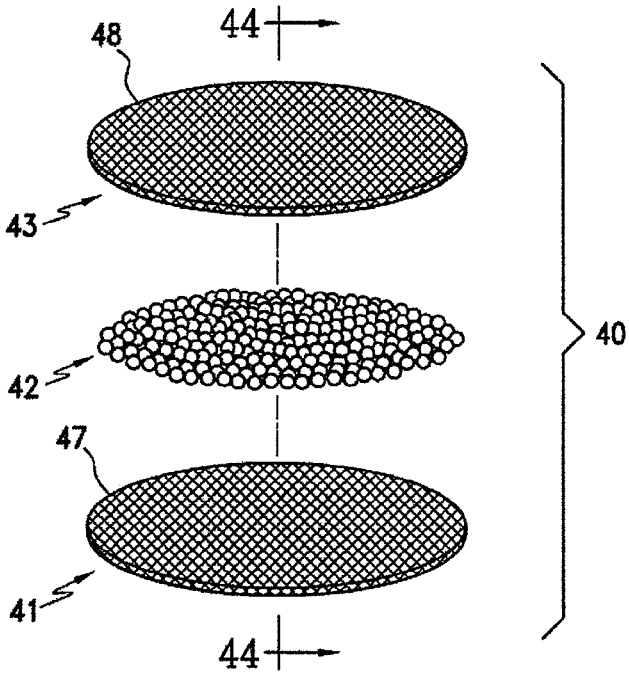
FIG. 4 is an exploded perspective view of the components of an apparatus according to another embodiment of the present invention.

Referring now to FIG. 4, humidification regulating apparatus 40 is shown in exploded perspective view. Apparatus 40 comprises a first sheet 41 of a first porous material having a first peripheral edge 47, preferably an FDA approved material, which is pervious to water vapor. Apparatus 40 also comprises a second sheet 43 of a second porous material having a second peripheral edge 48, preferably an FDA approved material, which is pervious to water vapor. In an alternative embodiment, not shown, either of the first sheet or the second sheet comprises a porous material, but not both sheets. The first and second sheets are joined or adhered together (e.g., with glue, stitching, a clamp or similar means) about the first and second edges, as shown in FIG. 5, which is a cross-sectional view of the apparatus 40 shown in FIG. 4, taken along line 44-44.

Apparatus 40 also comprises a composition 42 capable of adsorbing or desorbing water, such as a moisture-sensitive silica material, disposed between the first sheet 41 and the second sheet 43 in an inner region defined by the attached first and second peripheral edges 47, 48. As described above, the composition 42 controls relative humidity to a predetermined level through absorbing or releasing water vapor through the two sheets 41, 43.

Figure 5:
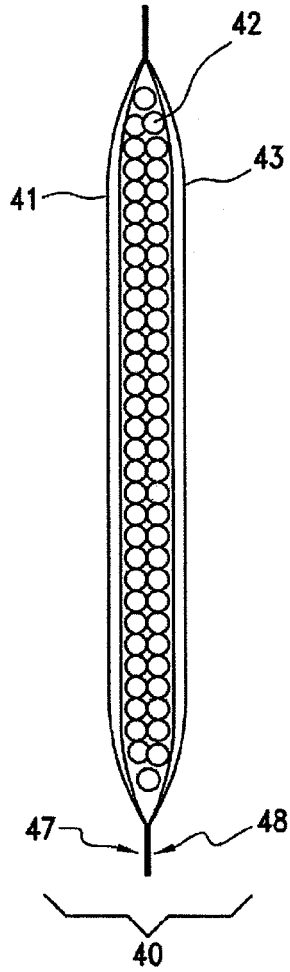
FIG. 5 is a side cross-sectional view of the embodiment of the invention shown in FIG. 4, taken along lines 44-44.
Figure 6:
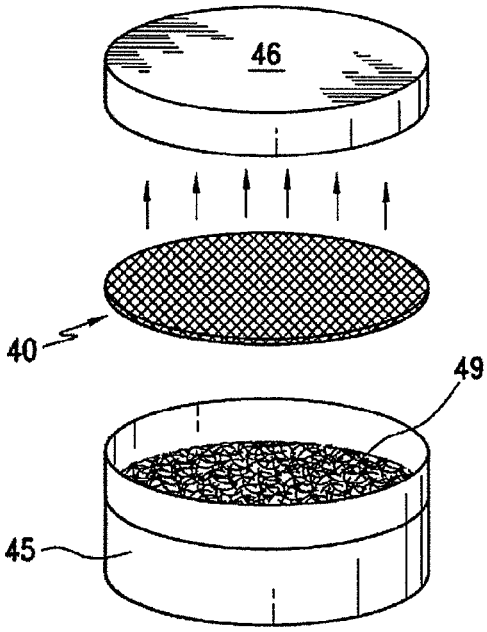
FIG. 6 is an exploded perspective view of the components of an apparatus according to another embodiment of the present invention.

The embodiment shown in FIGS. 4 & 5 may be simply placed within a cigar box or humidor, or in a container for holding smokeless tobacco or other environment wherein humidity enhancement is desired. Alternatively, as shown in FIG. 6, the apparatus 40 may also be affixed, optionally removably affixed, to the interior surface of a lid 46 of a cigar box or humidor, or smokeless tobacco container 45 using a securing device, such as a magnet or hook and loop fabric, such the fabric sold under the trademark VELCRO® or an adhesive including but not limited to glue or rubber cement. In this aspect, the lid 46 preferably comprises a non-porous major planar surface, and the apparatus optionally covers at least about 50%, at least about 75%, at least about 90% or at least about 95% of the surface of the non-porous major planar surface. Alternatively, the apparatus 40 may be simply placed between the lid 46 and the product 49 (e.g., tobacco) contained in the container 45, in which case the apparatus 40 simply rests on the product 49 while in a normal position.

While the present invention has been described with reference to exemplary embodiments, it is understood that the words that have been used are words of description and illustration, rather than words of limitation. Changes may be made, within the purview of the appended claims, as presently stated and as amended, without departing from the scope and spirit of the present invention in its aspects.

Although the invention has been described herein with reference to particular means, materials and embodiments, the invention is not intended to be limited to the particulars disclosed herein. Instead, the invention extends to all functionally equivalent structures, methods and uses, such as are within the scope of the appended claims, as prescribed by law.

What is claimed is:

1. A method for controlling a humidity level within an enclosed volume storage device, comprising:

(a) providing a container having outer walls defining an inner volume, at least one of the outer walls having perforations therein, wherein the container contains a composition capable of adsorbing and desorbing water in the inner volume;

(b) hydrating the composition to a hydration level less than about 0.13 mL water per gram of the composition; and (c) situating the container in the enclosed volume storage device, wherein the composition comprises a material selected from the group consisting of silicic acid, amorphous silicon dioxide, a lithium chloride composition, and combinations thereof;

wherein the lithium chloride composition consists essentially of silica, amorphous silica, and lithium chloride.

2. The method of claim 1, wherein the hydration level is from about 0.017 to about 0.13 mL water per gram of the composition.

3. The method of claim 1, wherein the hydration level is from about 0.085 to about 0.11 mL water per gram of the composition.

4. The method of claim 1, wherein the composition comprises silica.

5. The method of claim 1, wherein the composition comprises amorphous silica.

6. The method of claim 1, further comprising:

(d) maintaining a substantially constant humidity level within the storage device.

7. The method of claim 1, wherein the container further comprises a moisture-absorbent foam element or porous material disposed between the composition and the perforated wall of the container.

8. The method of claim 1, wherein the container further comprises a porous retaining element disposed between the composition and the perforations.

9. The method of claim 1, wherein the container comprises a perforated lid removably secured to a base, and wherein the process further comprises:

(d) securing the lid to the base after the hydrating step.

10. The method of claim 1, wherein said container is in the form of a cylindrical disc.

11. The method of claim 1, wherein said container has a diameter and a longitudinal length, and wherein the longitudinal length is at least 4 times greater than the diameter.

* * * * *